US009943151B2

(12) United States Patent
Fenton et al.

(10) Patent No.: US 9,943,151 B2
(45) Date of Patent: Apr. 17, 2018

(54) PORTABLE ELECTRONIC DEVICE CASE

(71) Applicant: Fairhaven Group, Inc., Seattle, WA (US)

(72) Inventors: Timothy John Fenton, Mercer Island, WA (US); Gary Allen Ashley, Seattle, WA (US)

(73) Assignee: PIONEER SQUARE BRANDS, INC., McLean, VA (US)

( * ) Notice: Subject to any disclaimer, the term of this patent is extended or adjusted under 35 U.S.C. 154(b) by 107 days.

(21) Appl. No.: 14/883,631

(22) Filed: Oct. 15, 2015

(65) Prior Publication Data

US 2016/0209881 A1 Jul. 21, 2016

Related U.S. Application Data

(63) Continuation-in-part of application No. 14/599,742, filed on Jan. 19, 2015, now Pat. No. 9,427,057.

(51) Int. Cl.
*B65D 85/00* (2006.01)
*A45C 11/00* (2006.01)

(52) U.S. Cl.
CPC ..... *A45C 11/00* (2013.01); *A45C 2011/003* (2013.01)

(58) Field of Classification Search
USPC ..... 206/320, 472, 473, 829
See application file for complete search history.

(56) References Cited

U.S. PATENT DOCUMENTS 2,451,194 A * 10/1948 Braun ..... F16B 47/00 206/813
3,635,332 A * 1/1972 Ross ..... B65D 81/07 206/477
4,611,716 A * 9/1986 Sorlien ..... A45D 27/22 132/316
4,799,587 A * 1/1989 Desanto ..... A45C 11/32 206/37.6
4,842,136 A * 6/1989 Nakazato ..... G03F 1/66 16/48.5
5,320,225 A * 6/1994 Kirkpatrick ..... G03F 1/66 206/449
6,109,434 A * 8/2000 Howard, Jr. ..... G06F 1/1601 206/320
6,321,912 B1 * 11/2001 Lippert ..... A45C 5/14 206/320
6,772,879 B1 * 8/2004 Domotor ..... A45C 11/00 206/320

(Continued)

*Primary Examiner* — Jacob K Ackun
(74) *Attorney, Agent, or Firm* — Grandview Law

(57) ABSTRACT

Systems and methods are involved with but are not limited to: a first case portion including a first interior portion, the first interior portion including a first layer, a support member, and a plurality of first protrusions, the support member pivotally coupled with the first layer to allow for pivotal movement of the support member about the first layer, the plurality of first protrusions coupled to the support member and extending therefrom, the plurality of first protrusions configured to affixedly engage with one or more smooth surface portions of a rear side portion of a portable device display assembly. In addition to the foregoing, other method aspects are described in the claims, drawings, and text forming a part of the present disclosure.

7 Claims, 9 Drawing Sheets

(56) References Cited

U.S. PATENT DOCUMENTS

| | | | | |
|---|---|---|---|---|
| 7,191,926 | B1 * | 3/2007 | Costantino | A45C 3/02 190/102 |
| 8,708,140 | B2 * | 4/2014 | Liu | A45C 11/00 206/320 |
| 8,887,902 | B1 * | 11/2014 | Liu | G06F 1/1628 206/320 |
| 2001/0040109 | A1 * | 11/2001 | Yaski | A45F 5/00 206/320 |
| 2003/0150756 | A1 * | 8/2003 | Kajiya | A45C 13/02 206/320 |
| 2004/0134813 | A1 * | 7/2004 | Domotor | A45C 3/02 206/320 |
| 2006/0060485 | A1 * | 3/2006 | Picot | A45C 5/00 206/320 |
| 2006/0226040 | A1 * | 10/2006 | Medina | G06F 1/1616 206/320 |
| 2007/0119734 | A1 * | 5/2007 | Pichahchi | A45C 13/02 206/320 |
| 2009/0032421 | A1 * | 2/2009 | Sween | A45C 3/02 206/320 |
| 2010/0044259 | A1 * | 2/2010 | Wang | A45C 3/02 206/320 |
| 2011/0011759 | A1 * | 1/2011 | Luo | A45C 5/03 206/320 |
| 2012/0118770 | A1 * | 5/2012 | Valls | F16M 11/10 206/320 |
| 2013/0001107 | A1 * | 1/2013 | Armstrong | A45F 5/00 206/216 |

* cited by examiner

PORTABLE ELECTRONIC DEVICE CASE

RELATED APPLICATIONS

For purposes of the USPTO extra-statutory requirements, the present application constitutes a continuation-in-part of U.S. patent application Ser. No. 14/599,742, entitled PORTABLE ELECTROIC DEVICE CASE, naming Gary Allen Ashley and Timothy John Fenton as inventors, filed 19 Jan. 2015, which is currently co-pending or is an application of which a currently co-pending application is entitled to the benefit of the filing date.

CROSS-REFERENCE TO RELATED APPLICATIONS

The present application is related to and claims the benefit of the earliest available effective filing date(s) from the following listed application(s) (the "Related Applications") (e.g., claims earliest available priority dates for other than provisional patent applications or claims benefits under 35 USC § 119(e) for provisional patent applications, for any and all parent, grandparent, great-grandparent, etc. applications of the Related Application(s)). All subject matter of the Related Applications and of any and all parent, grandparent, great-grandparent, etc. applications of the Related Applications is incorporated herein by reference to the extent such subject matter is not inconsistent herewith.

SUMMARY

In one aspect, an apparatus includes, but is not limited to a first case portion including a first interior portion, the first interior portion including a first layer, a support member, and a plurality of first protrusions, the support member pivotally coupled with the first layer to allow for pivotal movement of the support member about the first layer, the plurality of first protrusions coupled to the support member and extending therefrom, the plurality of first protrusions configured to affixedly engage with one or more smooth surface portions of a rear side portion of a portable device display assembly. In addition to the foregoing, other method aspects are described in the claims, drawings, and text forming a part of the disclosure set forth herein.

In addition to the foregoing, various other aspects are set forth and described in the teachings such as text (e.g., claims and/or detailed description) and/or drawings of the present disclosure. The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of embodiments, reference now is made to the following descriptions taken in connection with the accompanying drawings. The use of the same symbols in different drawings typically indicates similar or identical items, unless context dictates otherwise.

With reference now to the figures, shown are one or more examples of disparate material outsole based articles of manufacture, compositions of matter, systems for producing and/or methods for producing same that may provide context, for instance, in introducing one or more processes and/or devices described herein.

DETAILED DESCRIPTION

Figure 1:
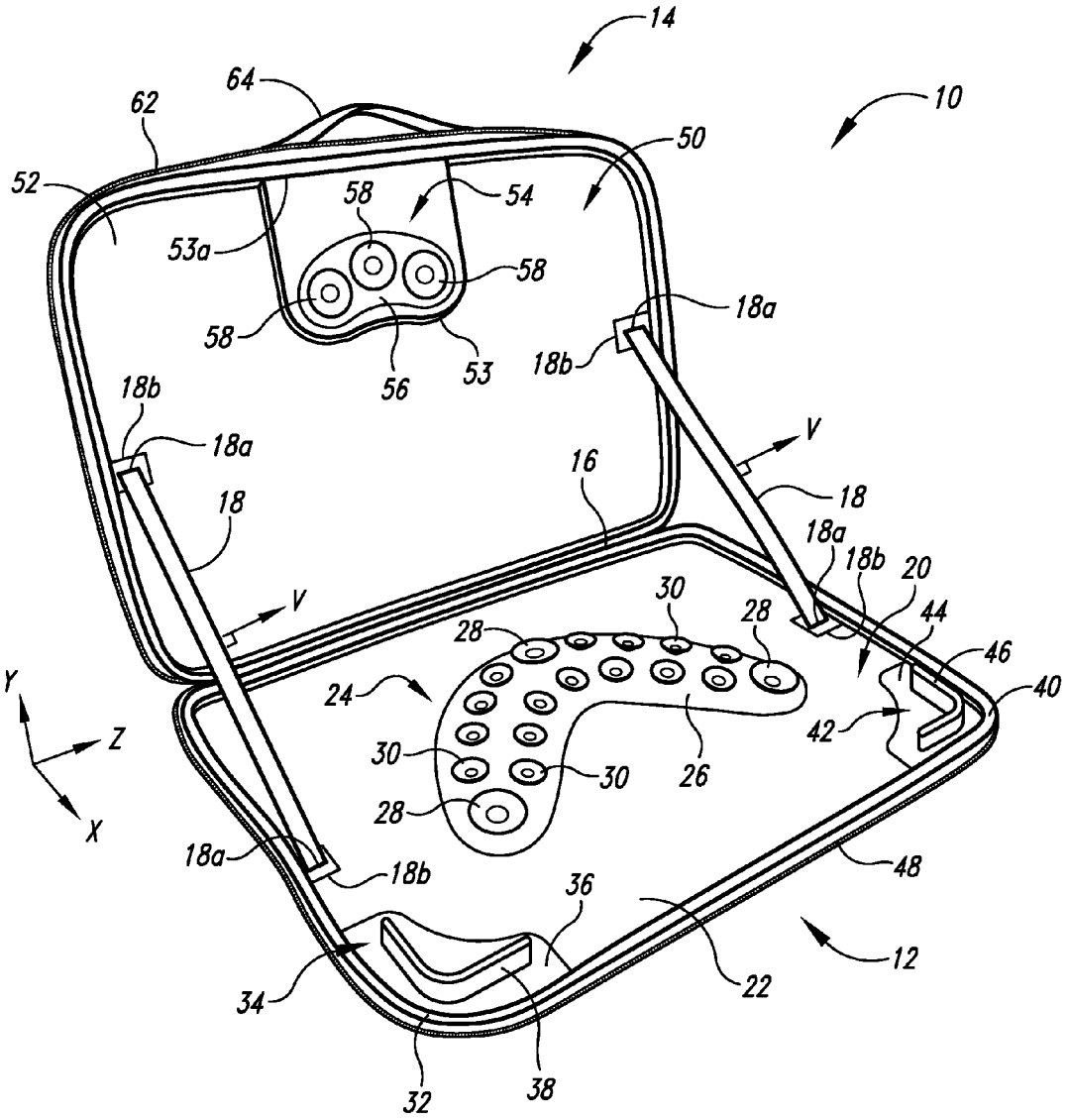
FIG. 1 is a perspective view of a portable electronic device case shown as opened up in an open disposition.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Conventional cases for portable electronic devices can use straps and other securing means that can cause obstructions and be visually and tactilely displeasing. Furthermore, use of cases that are always affixed to devices can cause unwanted heat buildup during device operation.

Referring now to FIG. 1, portable device case 10 is depicted as opened up in an open disposition and as having first case portion 12 and second case portion 14 with flexible hinge-like portion 16 positioned there betwixt to allow for axially oriented motion of the first case portion 12 and the second case portion 14 relative therebetween. The portable device case 10 also includes support straps 18 to provide further support between the first case portion 12 and the second case portion 14.

In the embodiment shown, flat or ribbon-like straps as the support straps 18 extend from and/or are affixed to first case portion 12 and second case portion 14 at interface points 18*a* such that when the electronic device case 10 is in an open position with the support straps 18 taut, each support strap can, as illustrated, be positioned such that, as depicted in FIG. 1, an illustrative vector, v, drawn in FIG. 1 for elucidation purposes is normal to the flat surfaces of the support strap. Furthermore, the illustrative normal vector, v, can be, as depicted, be positioned with respect to an illustrative x-y-z coordinate axes, drawn in FIG. 1 for elucidative purposes, in which the illustrative z-axis of the illustrative x-y-z coordinate axes is substantially parallel to the flexible hinge-like portion 16 and the normal vector, v, is substantially parallel to a plane formed by the illustrative x-y coordinate axes. In other words, the support straps 18 can be positioned when taut such that the illustrative normal vector, v, can be substantially perpendicular to an illustrative line that is parallel to the longitudinal extension of the flexible hinge-like portion 16.

As depicted, interface points 18*a* are shown with reinforcement 18*b*.

The first case portion 12 includes first interior 20 further including first layer 22 and first protrusion assembly 24. The first layer 22 can be made from a fabric or other flexible material. The first protrusion assembly 24 can be a single molded piece and includes first protrusion base member 26 with first sized protrusion 28 and second sized protrusion 30 extending therefrom. The first sized protrusion 28 and the second sized protrusion 30 can be made from a high grade silicone or other similarly deformable material and are depicted as variously sized suction cups in the exemplary implementation. The first interior 20 further includes first case corner 32 and first corner guard assembly 34 located therein. The first corner guard assembly 34 includes first corner base member 36 and first corner guard member 38, which can be a single piece molded from a high grade silicone or other resilient material. In addition, the first interior 20 further includes second case corner 40 and second corner guard assembly 42 located therein. The second corner guard assembly 42 includes second corner base member 44 and second corner guard member 46, which can also be molded from a high grade silicone or other resilient material. The first corner guard member 38 and second corner guard member 46 of the first corner guard assembly 34 and the second corner guard assembly 42, respectively, with their perpendicularly oriented wall portions form corner-shaped supports to engage with device housing corners to help secure a contained portable electronic device such as a laptop to prevent sliding of such therein or accidental ejection of such there out.

The second case portion 14 includes second interior 50, which includes second layer 52 and support member 53 with second protrusion assembly 54 affixed thereto. The second layer 52 can be made from a fabric or other flexible material. The support member 53*a* extends from and/or is hingedly affixed to other portions of the second case portion 14 at flexible hinge-like portion 53*a* to allow for movement of the support member 53 with respect to other portions of the second case portion 14, in some embodiments, about an axis that is in some embodiments, such as depicted in FIG. 1, substantially parallel to an axis formed by the flexible hinge-like portion 16 as depicted by illustrative Z axis of illustrative x-y-z coordinate axes of FIG. 1.

Figure 5A:
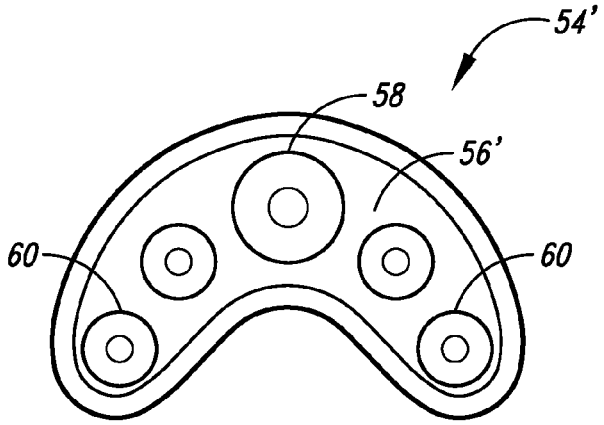
FIG. 5A is a top plan view of an alternative second protrusion assembly of the portable electronic device case of FIG. 1, the second protrusion assembly depicted as containing suction cup protrusions.
Figure 5B:
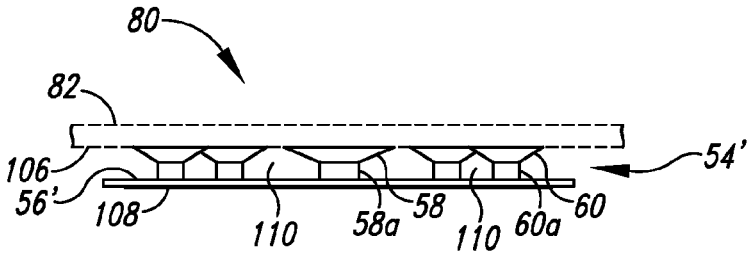
FIG. 5B is a side elevational view of the alternative second protrusion assembly of FIG. 5A.
Figure 5C:
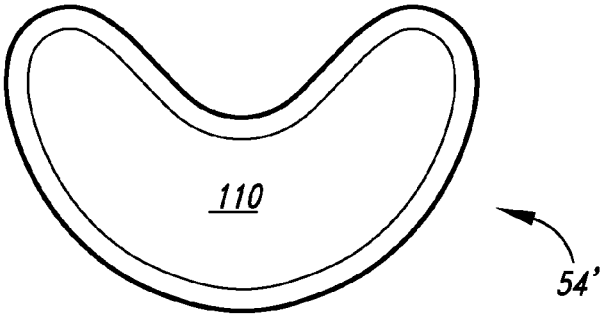
FIG. 5C is a bottom plan view of the alternative second protrusion assembly of FIG. 5A.

The second protrusion assembly 54 includes second protrusion base member 56 with first sized protrusion 58 and alternatively with second sized protrusion 60 as shown with alternative second protrusion assembly 54' having alternative second protrusion base member 56' of FIG. 5A-5C. Continuing on with describing FIG. 1, the first sized protrusion 58 and the second sized protrusion 60 can be made from a high grade silicone or other similarly deformable material and are depicted as variously sized suction cups. Depicted locations of the second corner guard member 46 and the second corner guard member 46 are exemplary such that other positions can be selected for instance to avoid unsmooth surface engagement (such as device feet or vents) with the first sized protrusion 28, second sized protrusion 30, first sized protrusion 58, and second sized protrusion 60. Also the first sized protrusion 28, second sized protrusion 30, first sized protrusion 58, and second sized protrusion 60 can include more variations in size such as more variation in size of suction cups.

Figure 2:
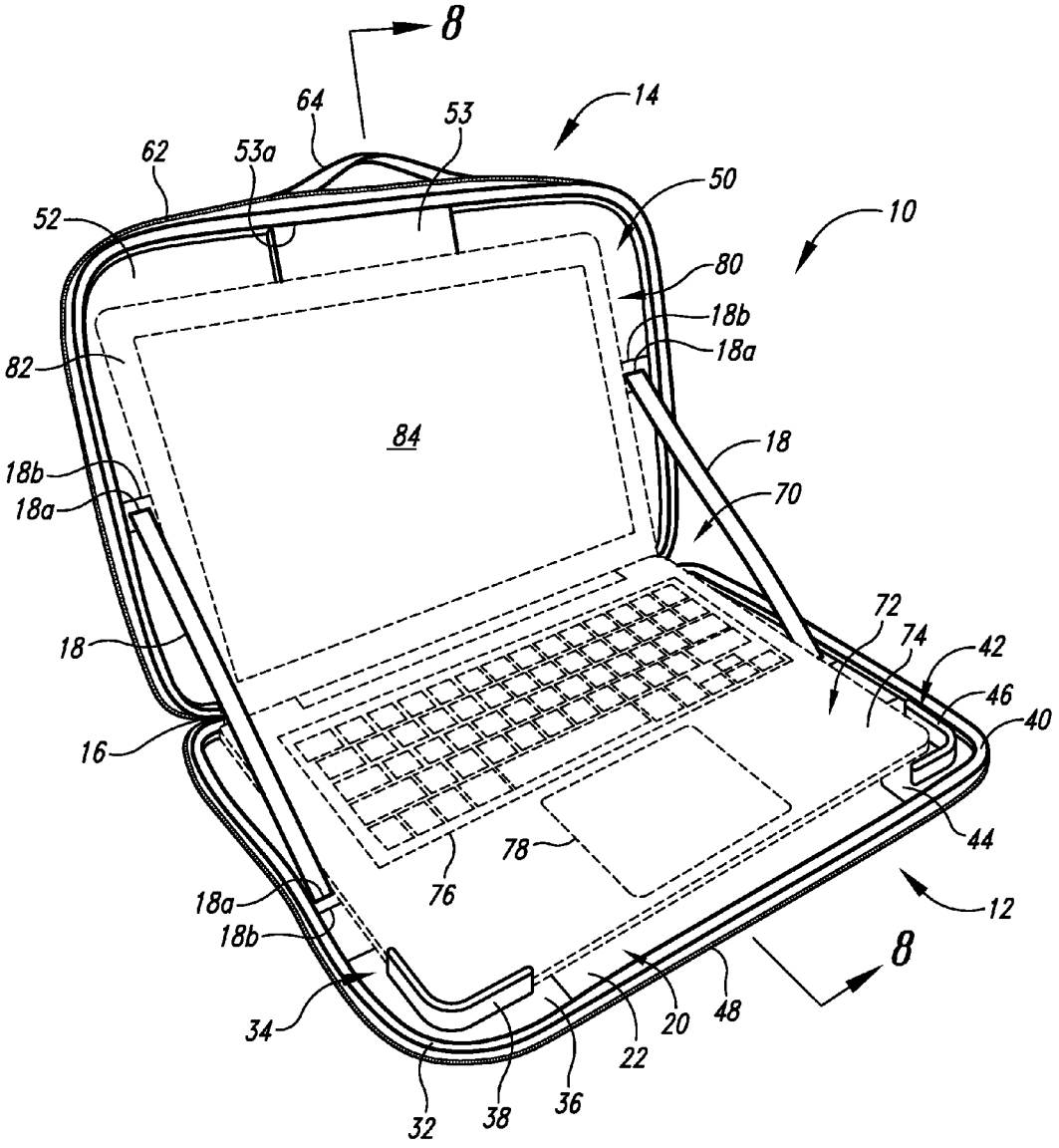
FIG. 2 is a perspective view of the portable electronic device case of FIG. 1 shown as opened up in an open disposition containing an exemplary portable electronic device as a laptop computer.

As depicted in FIG. 2, the portable device case 10 is shown as opened up in an open disposition and as containing a portable electronic device 70 depicted as a laptop computer. The exemplary portable electronic device 70 is shown as having portable device keyboard assembly 72 including keyboard assembly front side portion 74, keyboard surface portion 76, and touch pad surface portion 78. The exemplary portable electronic device 70 is also shown as having portable device display assembly 80 including display assembly front side portion 82 and display surface portion 84.

Figure 3:
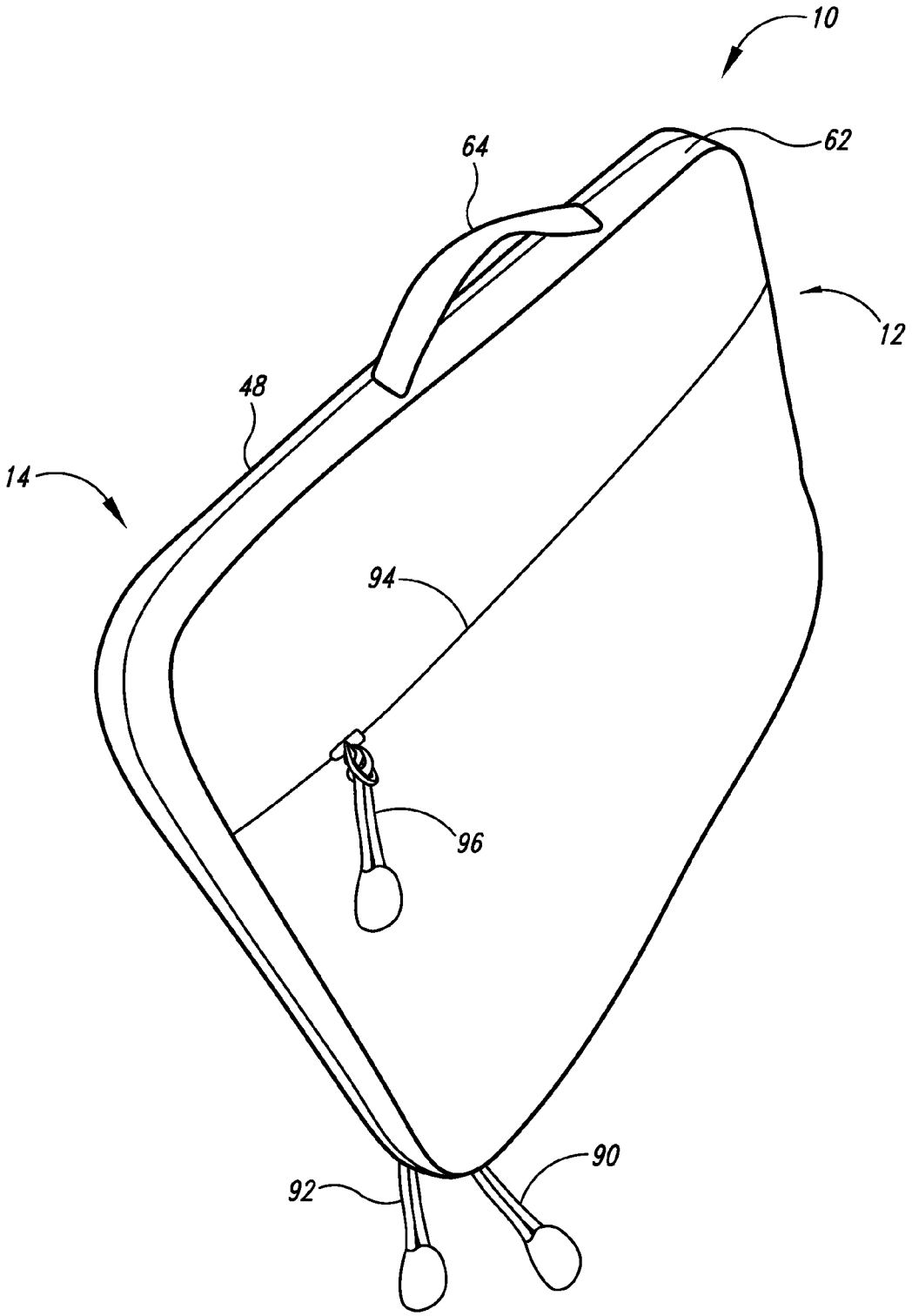
FIG. 3 is a perspective view of the portable electronic device case of FIG. 1 shown as closed up in a closed disposition.

Referring now to FIG. 3, depicted therein is the portable device case 10 as closed up in a closed disposition with the first zipper portion 48 and the second zipper portion 62 mated together in a zippered disposition. In addition, the portable device case 10 is shown as having zipper handle 90, zipper handle 92, zipper 94, and zipper handle 96 as well. Alternatively, the portable device case 10 could employ fastening means other than zipper mechanisms such as snaps, buckles, Velcro flaps, etc.

Figure 4A:
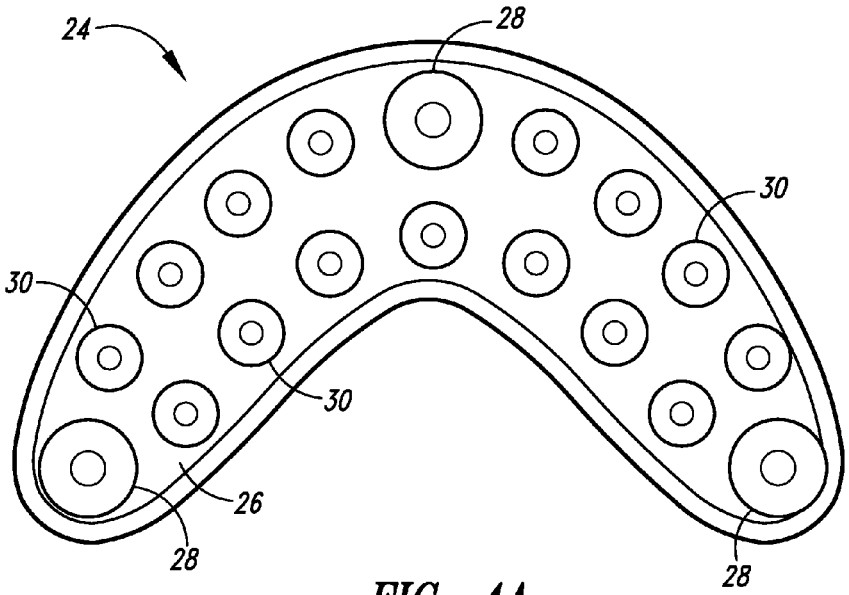
FIG. 4A is a top plan view of a first protrusion assembly of the portable electronic device case of FIG. 1, the first protrusion assembly depicted as containing suction cup protrusions.
Figure 4B:
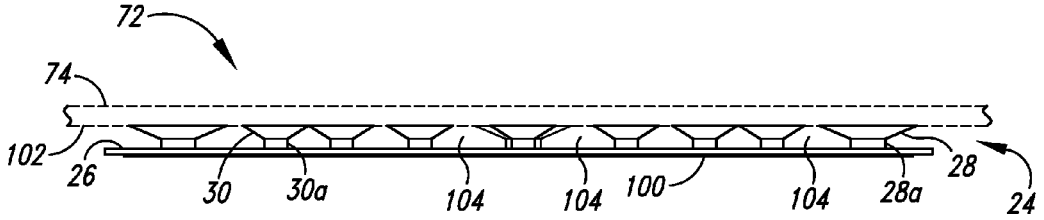
FIG. 4B is a side elevational view of the first protrusion assembly of FIG. 4A.
Figure 4C:
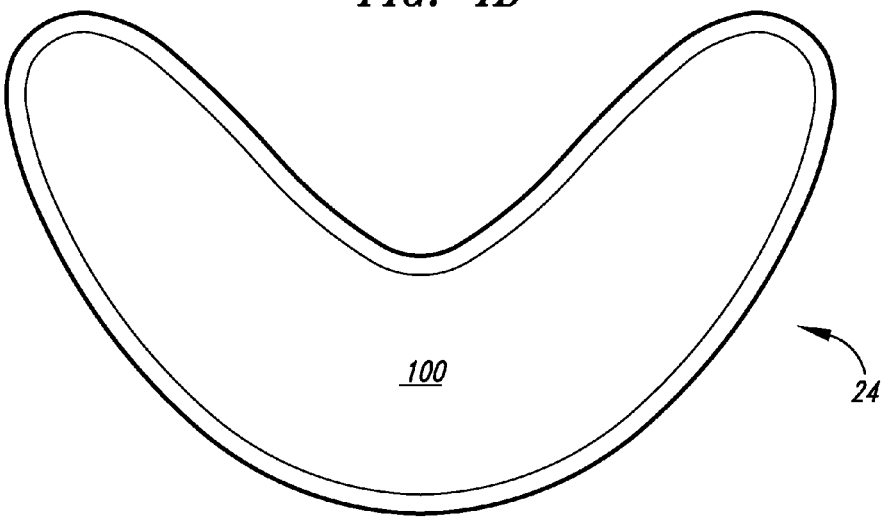
FIG. 4C is a bottom plan view of the first protrusion assembly of FIG. 4A.

Further depicted in FIGS. 4A, 4B, and 4C is the first protrusion assembly 24 shown in FIG. 4B as including back side of first protrusion base member 100, which can be affixed to the first layer 22 of the first interior 20 by adhesive, sewing (such around a periphery of the first protrusion base member 26), stapling, bolting, slotted engagements, slide-lock into rigid connection, etc. The back side of first protrusion base member 100 can be other shapes and sizes such as rectangular as a rectangular shape and can also be further affixed to other structural layers such as one or more fabric, foam, plastic, rigid board panels, that can make up additional internal layers of the first case portion 12 to reduce flexing movement of the first sized protrusion 28 and the second sized protrusion 30, such as depicted as suction cups. The first protrusion assembly 24 is further shown with its first sized protrusion 28 and second sized protrusion 30 fixedly engaged with a smooth surface portion of keyboard assembly rear side portion 102 of the portable device keyboard assembly 72. The first sized protrusion 28 and the second sized protrusion 30 are further shown as having support stem 28*a* and support stem 30*a*, respectively, both extending from the first protrusion base member 26 of the first protrusion assembly 24. The support stem 28*a* and the support stem 30*a* further extend the keyboard assembly rear side portion 102 of the portable device keyboard assembly 72 away from the first protrusion base member 26 thereby creating air gap 104, which can aid in cooling of the portable electronic device 70.

Further depicted in FIGS. 5A, 5B, and 5C is the alternative second protrusion assembly 54' shown in FIG. 5B as including air gap 110, which can be affixed to the second layer 52 of the second interior 50 by adhesive, sewing (such around a periphery of the second protrusion base member 56), stapling, bolting, slotted engagements, slide-lock into rigid connection, etc. The second protrusion base member back side 108 can be other shapes and sizes such as rectangular as a rectangular shape and can also be further affixed to other structural layers such as one or more fabric, foam, plastic, one or more rigid board panels that can make up additional internal layers of the second case portion 14 to reduce flexing movement of the first sized protrusion 58 and the second sized protrusion 60, such as depicted as suction cups. The second protrusion assembly 54 is further shown with its first sized protrusion 58 and second sized protrusion 60 fixedly engaged with a smooth surface portion of display assembly rear side portion 106 of the portable device display assembly 80. The first sized protrusion 58 and the second sized protrusion 60 are further shown as having support stem 58*a* and support stem 60*a*, respectively, both extending from the alternative second protrusion base member 56' of the alternative second protrusion assembly 54'. The support stem 58*a* and the support stem 60*a* further extend the display assembly rear side portion 106 of the portable device display assembly 80 away from the alternative second protrusion base member 56' of the second protrusion assembly 54' thereby creating air gap 110, which can aid in cooling of the portable electronic device 70. These considerations discussed can also be applicable to embodiments of the second protrusion assembly 54 and the second protrusion base member 56.

Figure 6A:
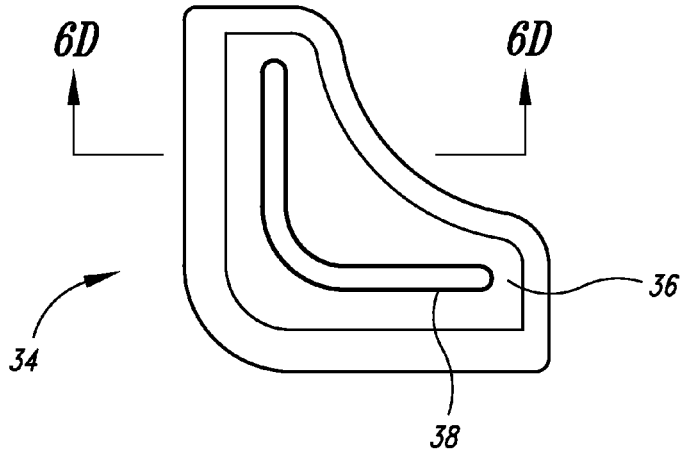
FIG. 6A is a top plan view of a first corner guard assembly of the portable electronic device case of FIG. 1.
Figure 6B:
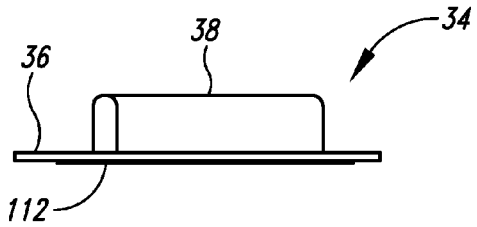
FIG. 6B is a side elevational view of the first corner guard assembly of FIG. 6A.
Figure 6C:
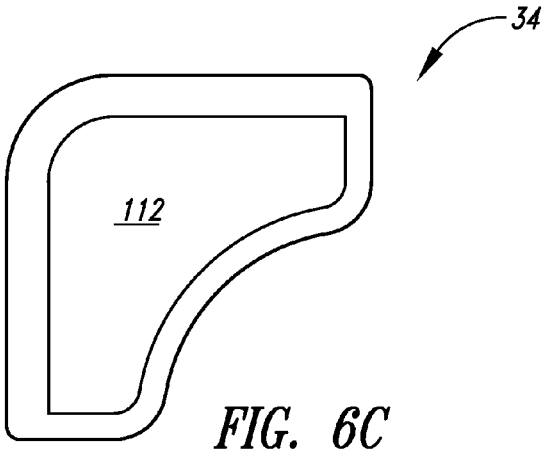
FIG. 6C is a bottom plan view of the first corner guard assembly of FIG. 6A.
Figure 6D:
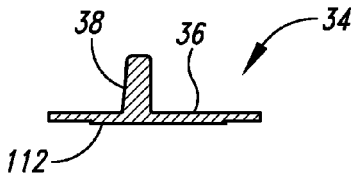
FIG. 6D is a cross-sectional side elevational view along cut-line 6D-6D of the first corner guard assembly of FIG. 6A.

Further depicted in FIGS. 6A, 6B, 6C, and 6D is the first corner guard assembly 34 shown in FIG. 6B as including first corner guard member back side 112, which can be affixed to the first layer 22 of the first interior 20 by adhesive, sewing, stapling, bolting, slotted engagements, etc.

Figure 7:
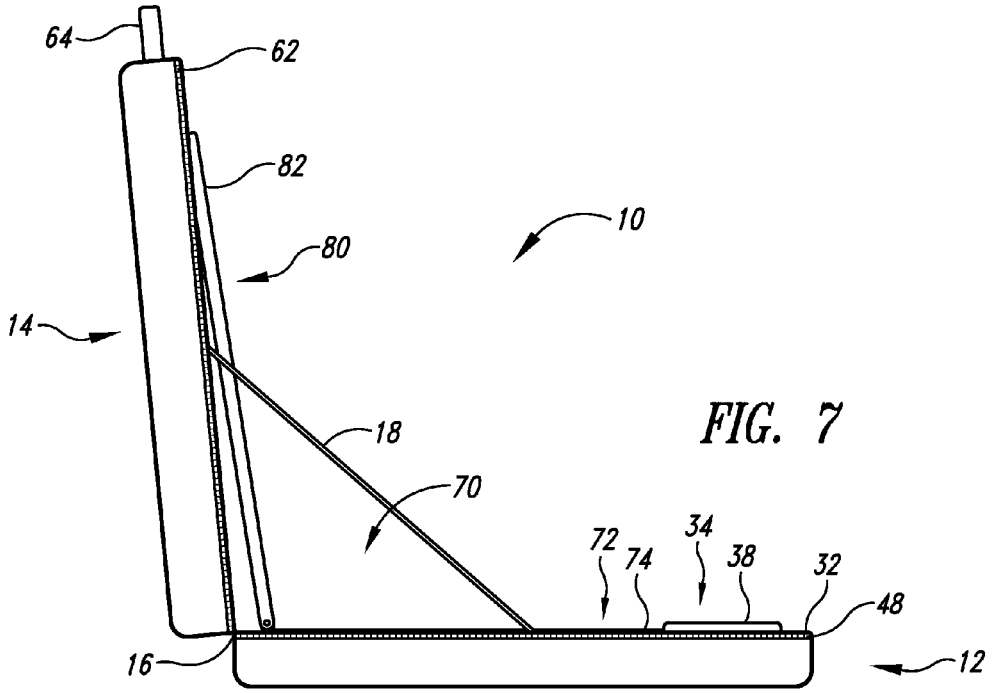
FIG. 7 is a side elevational view of the portable electronic device case of FIG. 1 in open disposition with its display assembly in a first position and with exemplary portable electronic device of FIG. 2.
Figure 8:
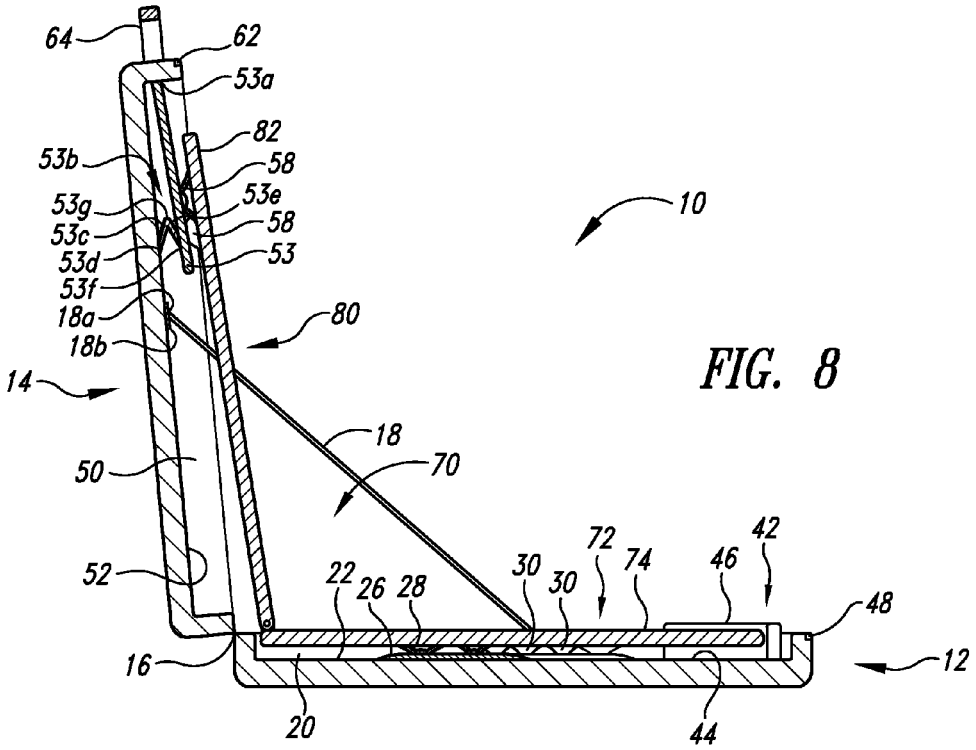
FIG. 8 is a cross-sectional side elevational view of the portable electronic device case and exemplary portable electronic device of FIG. 7.
Figure 9:
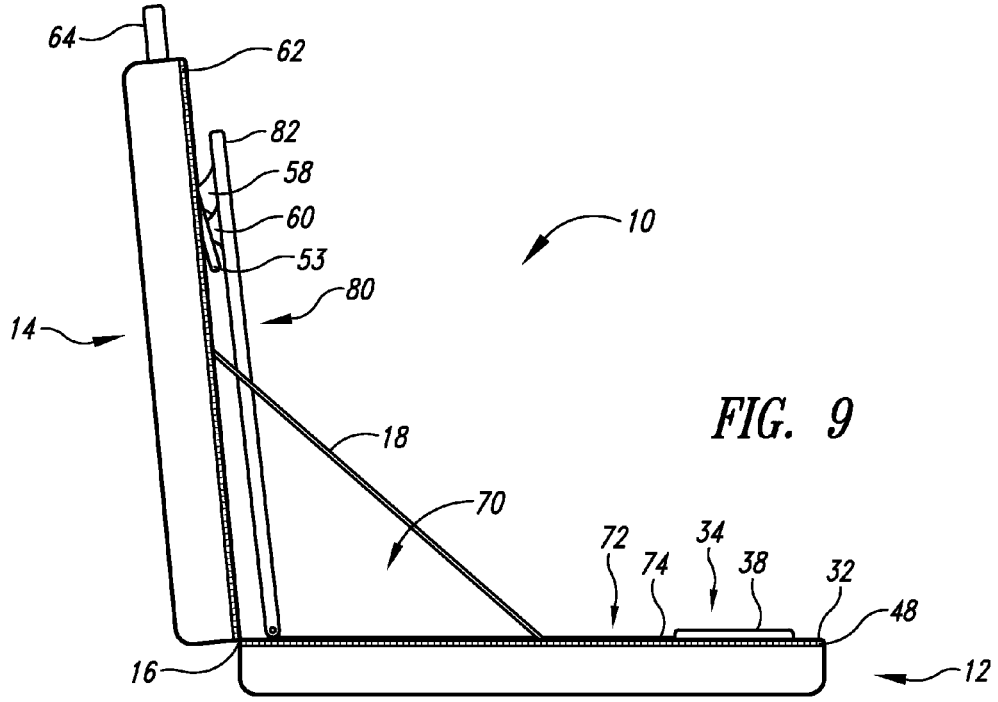
FIG. 9 is a side elevational view of the portable electronic device case of FIG. 1 in open disposition with its display assembly in a second position and with exemplary portable electronic device of FIG. 2.
Figure 10:
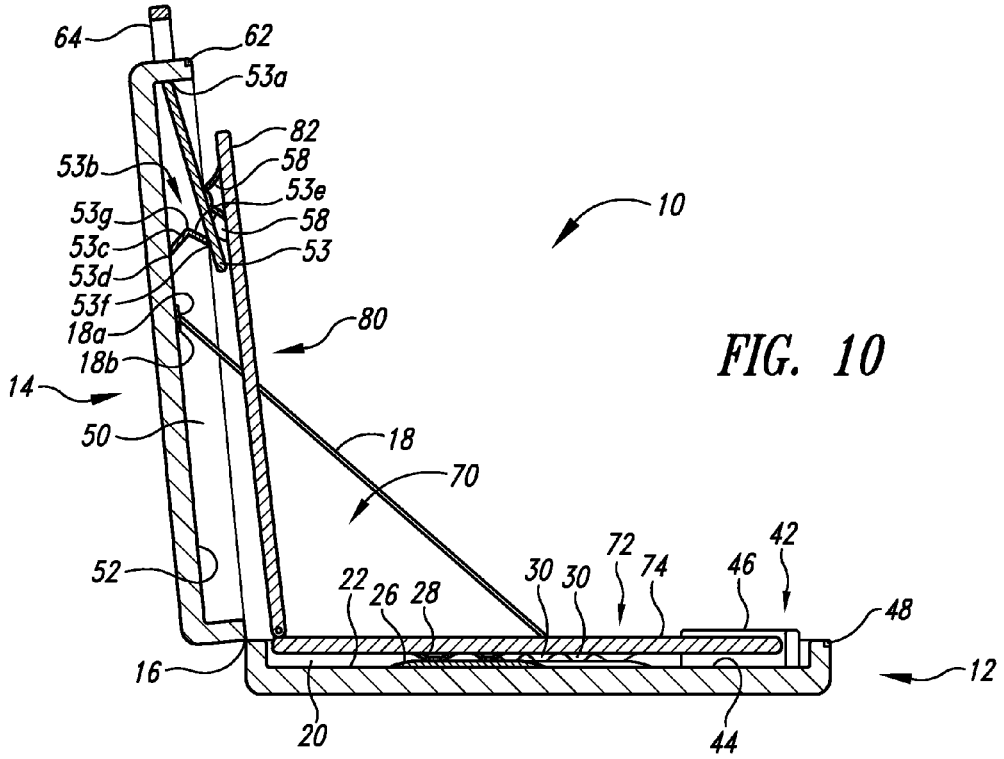
FIG. 10 is a cross-sectional side elevational view of the portable electronic device case and exemplary portable electronic device of FIG. 9.

FIGS. 7 and 8 depict the portable device display assembly 80 of the portable electronic device 70 in a first position relative to the second layer 52 of the second portion 52 and FIGS. 9 and 10 depict the display assembly 80 in a second position relative to the second layer 52. In the first position, the display assembly 80 is closer to the second layer 52 and in the second position, the display assembly 80 is farther from the second portion 52.

In the first position, the support member 53 is also closer to the second layer 52 than in the second position, so that in the first position linkage 53*b* is further retracted having its first member 53*c* and second member 53*e* pivoted about pivot 53*g* to be closer to each other. First member 53*c* extends from and/or is coupled to second layer 52 at portion 53*d* and second member 53*e* extends from and/or is coupled to the support member 53 at portion 53*f* to allow support member 53 to provide positioning support of display assembly 80 while also allowing support member to pivotally move about flexible hinge-like portion 53*a*.

Figure 11:
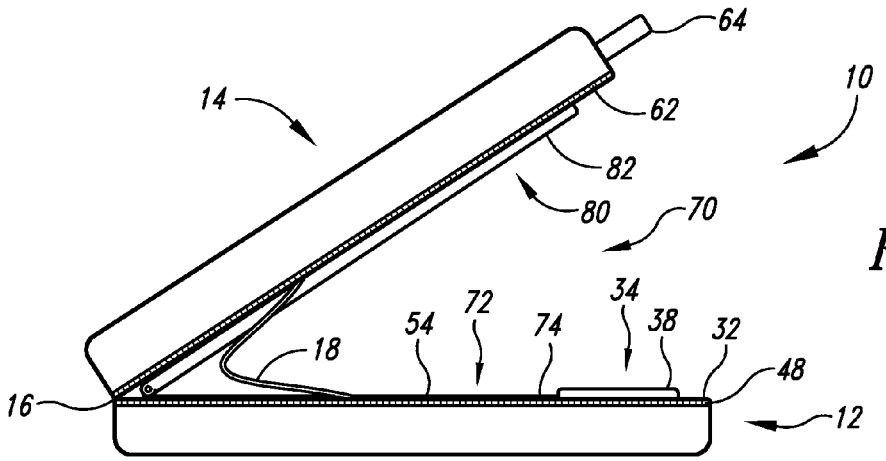
FIG. 11 is a side elevational view of the portable electronic device case of FIG. 1 in a semi-open disposition with its display assembly in a first position and with exemplary portable electronic device of FIG. 2.
Figure 12:
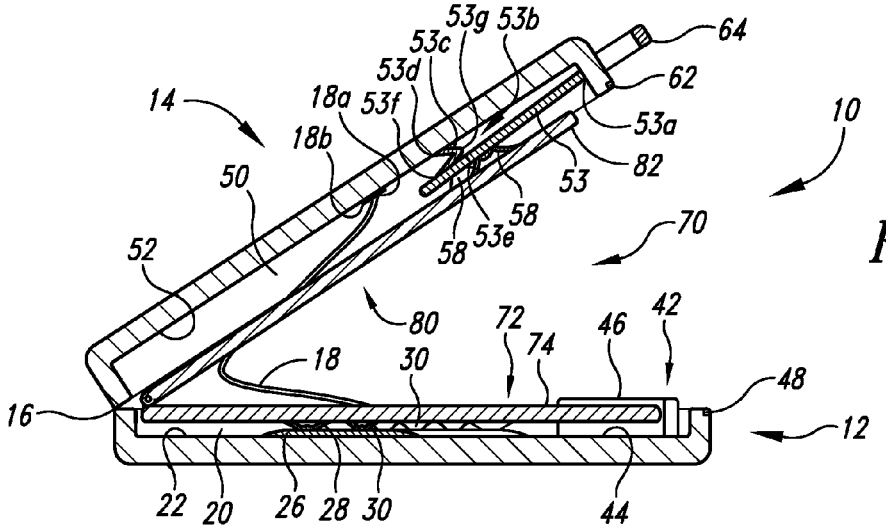
FIG. 12 is a cross-sectional side elevational view of the portable electronic device case and exemplary portable electronic device of FIG. 11.

FIG. 11 is a side elevational view of the portable electronic device case 10 in a semi-open disposition. FIG. 12 is a cross-sectional side elevational view of the portable electronic device case 10 and exemplary portable electronic device 70.

Figure 13:
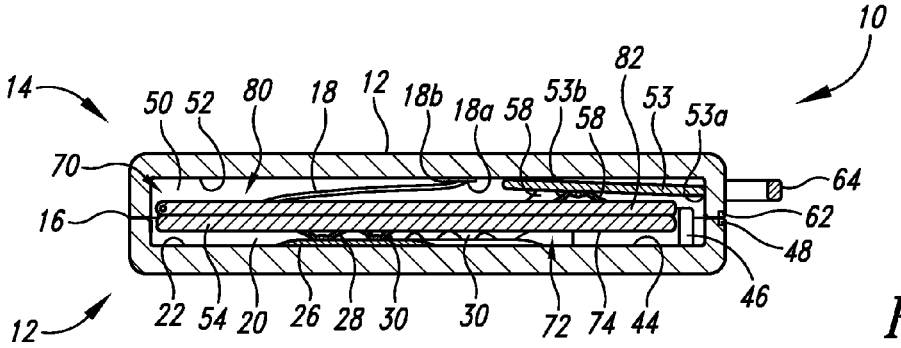
FIG. 13 is a cross-sectional side elevational view of the portable electronic device case of FIG. 1 in closed disposition with its display assembly in a first position and with exemplary portable electronic device of FIG. 2.

FIG. 13 is a cross-sectional side elevational view of the portable electronic device case of FIG. 1 in closed disposition. FIGS. 11-13 thus depict how positioning and shape of the support straps 18 allow for the support straps to be kept within the confines of the portable electronic device case 10 while the device case is being closed.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., " a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., " a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A portable electronic device case comprising:

a first case portion including a first interior portion, the first interior portion including a first protrusion assembly, the first protrusion assembly including a first base member, a plurality of first support stems, and a plurality of first suction cups, the plurality of first support stems coupled to and extending from the first base member, the plurality of first suction cups coupled to and extending from the first support stems; and a second case portion including a second interior portion, a support member and a second protrusion assembly, the second protrusion assembly including a second base member, a plurality of second support stems, and a plurality of second suction cups, the plurality of second support stems coupled to and extending from the second base member, the plurality of second suction cups coupled to and extending from the second support stems, the second base member coupled to the support member, the support member pivotally coupled to the second interior portion.

2. The portable electronic device case of claim 1 wherein the second protrusion assembly comprises a silicone material.

3. The portable electronic device case of claim 1 wherein the second protrusion assembly being a single formed piece.

4. The portable electronic device case of claim 1 wherein the second interior portion further comprises a layer, the second base member being sewn to the second layer.

5. The portable electronic device case of claim 1 further comprising the support member being coupled to the second interior portion via one or more linkages.

6. The portable electronic device case of claim 1 wherein the second case portion and the first case portion are hingedly coupled together.

7. The portable electronic device case of claim 1 wherein the second case portion and the first case portion are coupled together via a flexible hinge portion.

* * * * *